US009194202B2

(12) United States Patent
Puccio

(10) Patent No.: US 9,194,202 B2
(45) Date of Patent: Nov. 24, 2015

(54) FISHING TOOL FOR DRILL PIPE

(75) Inventor: William F. Puccio, Katy, TX (US)

(73) Assignee: Cameron International Corporation, Houston, TX (US)

( * ) Notice: Subject to any disclaimer, the term of this patent is extended or adjusted under 35 U.S.C. 154(b) by 545 days.

(21) Appl. No.: 13/197,647

(22) Filed: Aug. 3, 2011

(65) Prior Publication Data

US 2013/0032348 A1 Feb. 7, 2013

(51) Int. Cl.
*E21B 31/18* (2006.01)

(52) U.S. Cl.
CPC ..... *E21B 31/18* (2013.01)

(58) Field of Classification Search
CPC ..... E21B 31/00; E21B 31/12; E21B 31/18
USPC ..... 166/99, 301; 294/86.1, 86.26, 86.3, 294/86.31
See application file for complete search history.

(56) References Cited

U.S. PATENT DOCUMENTS

| | | | | |
|---|---|---|---|---|
| 1,581,010 | A | 4/1926 | Murray | |
| 1,646,965 | A | 10/1927 | Johnson | |
| 3,208,788 | A | 9/1965 | Roark | |
| 3,727,967 | A | 4/1973 | Anastasiu et al. | |
| 4,453,756 | A * | 6/1984 | Haag | 294/86.29 |
| 5,819,851 | A * | 10/1998 | Dallas | 166/308.1 |
| 5,865,253 | A * | 2/1999 | Gamper et al. | 166/301 |
| 6,095,583 | A * | 8/2000 | Beeman et al. | 294/86.15 |
| 6,719,052 | B1 * | 4/2004 | Harmon et al. | 166/301 |
| 2008/0136203 | A1 * | 6/2008 | Krijnen et al. | 294/91 |
| 2010/0252251 | A1 | 10/2010 | Harkins et al. | |
| 2011/0114321 | A1 | 5/2011 | Guidry et al. | |

FOREIGN PATENT DOCUMENTS

| | | | |
|---|---|---|---|
| CN | 201351472 | Y | 11/2009 |
| GB | 2402955 | A | 12/2004 |

OTHER PUBLICATIONS

U.S. Appl. No. 13/130,304, filed May 19, 2011, Vanderford et al.
PCT International Search Report & Written Opinion for PCT Application No. PCT/US2012/059608; dated Feb. 5, 2013.
SG Search Report & Written Opinion for SG Application No. 2014007017 mailed Dec. 10, 2014, 21 pages.

* cited by examiner

*Primary Examiner* — Nicole Coy
*Assistant Examiner* — Kristyn Hall
(74) *Attorney, Agent, or Firm* — Fletcher Yoder, P.C.

(57) ABSTRACT

A fishing tool is provided to enable retrieval of fish from a mineral extraction system. The fishing tool includes a frustoconical member, an outer tubular member, and an inner tubular member. The inner tubular member includes a plurality of receptacles configured to receive a plurality of jaws. Each of the jaws may include teeth on an inward facing surface of the jaw. The outer tubular member may be hydraulically actuated to cause the jaws to move radially inward and engage the fish, enabling removal of the tool and the fish. Systems and methods that include the fishing tool are also provided.

27 Claims, 8 Drawing Sheets

FISHING TOOL FOR DRILL PIPE

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

As will be appreciated, oil and natural gas have a profound effect on modern economies and societies. Indeed, devices and systems that depend on oil and natural gas are ubiquitous. For instance, oil and natural gas are used for fuel in a wide variety of vehicles, such as cars, airplanes, boats, and the like. Further, oil and natural gas are frequently used to heat homes during winter, to generate electricity, and to manufacture an astonishing array of everyday products.

In order to meet the demand for such natural resources, companies often invest significant amounts of time and money in searching for and extracting oil, natural gas, and other subterranean resources from the earth. Particularly, once a desired resource is discovered below the surface of the earth, drilling and production systems are often employed to access and extract the resource. These systems may be located onshore or offshore depending on the location of a desired resource. Further, such systems generally include a wellhead assembly through which the resource is extracted. These wellhead assemblies may include a wide variety of components, such as various casings, valves, fluid conduits, and the like, that control drilling and/or extraction operations.

To extract the resources from a well, a drilling riser may extend from the well to a rig. For example, in a subsea well, the drilling riser may extend from the seafloor up to a rig on the surface of the sea. A typical drilling riser may include a flanged assembly formed from steel, and the drilling riser may perform multiple functions. In addition to transporting drilling fluid into the well, the riser may provide pipes to allow drilling fluids, mud, and cuttings to flow up from the well. A drill pipe may be disposed inside the riser and connected to a drillbit or other tool at the end of the well. The riser may be coupled to a blowout preventer (BOP) that can seal off the well in certain situations.

During the drilling operation, operators may lose control of the well if unexpected or excess pressure occurs. Additionally, other events, such as weather, may cause operators to seal off the well in an emergency. During such events, the BOP may seal off the well, such as through the activation of rams in the BOP. These rams may bend, cut, shear, or otherwise deform the drill pipe or other components in the wellhead. The drill pipe, tools, or other equipment left in the well are referred to as "fish." Retrieval of the fish may be challenging, time-consuming, and expensive.

BRIEF DESCRIPTION OF THE DRAWINGS

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Embodiments of the present invention include a fishing tool to enable retrieval of fish from components of a mineral extraction system. The retrieval tool may include an upper frustoconical member, an outer tubular member, and an inner tubular member concentrically disposed around an axis. The fishing tool may be moved between an "unlocked position" and a "locked position," such that in the "locked position" the fishing tool is engaged with the fish to enable removal of the tool and the fish. The inner tubular member may include receptacles configured to receive a plurality of jaws having teeth on an inward facing surface. The outer tubular member may also include recesses to retain the jaws. The outer tubular member may be hydraulically actuated to translate, relative to the frustoconical member and inner tubular member, in an axial direction. The movement of the outer tubular member causes an angled surface of the recesses to exert an inward radial force on the jaws, causing the jaws to move radially inward and engage, e.g., "bite," into the fish. After engagement with the fish, the fishing tool and the fist may be removed.

Figure 1:
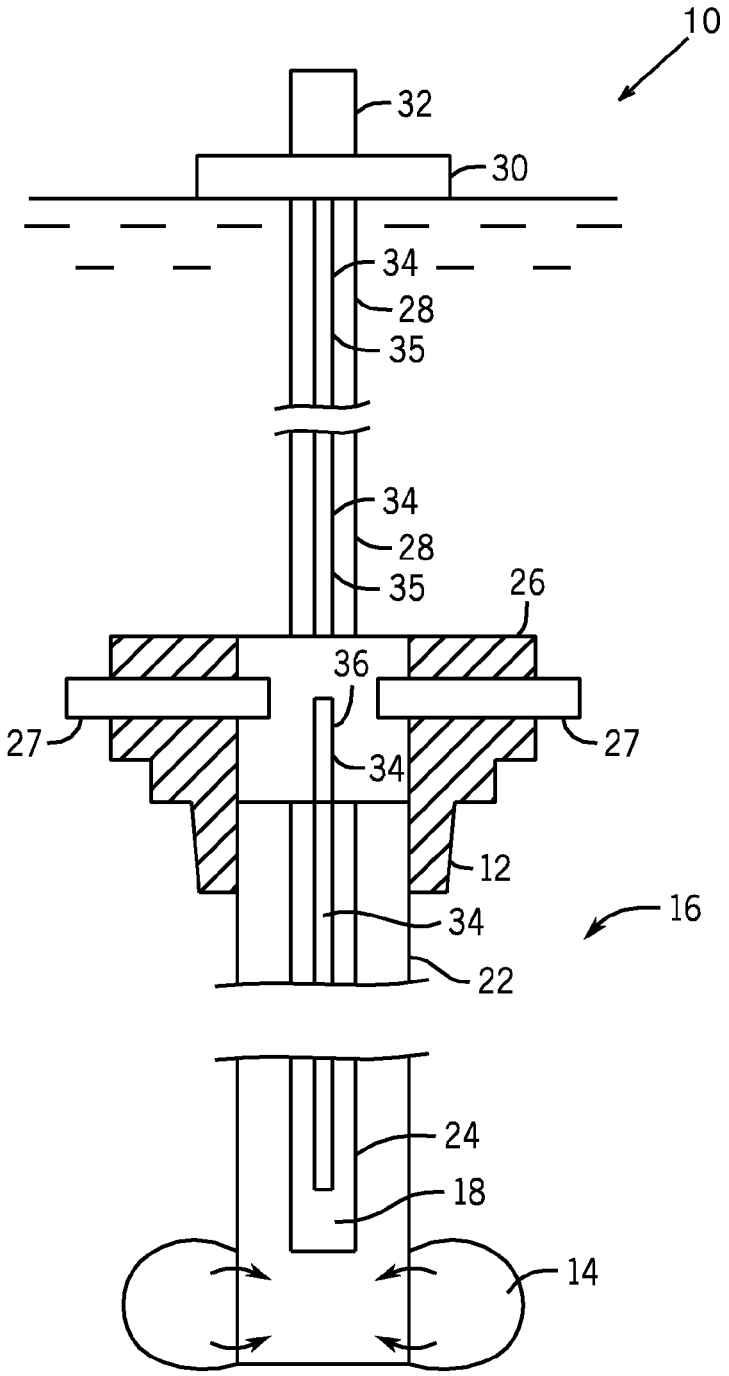
FIG. 1 is a block diagram of a mineral extraction system in accordance with an embodiment of the present invention.

FIG. 1 is a block diagram that illustrates an embodiment of a subsea mineral extraction system 10. The illustrated mineral extraction system 10 can be configured to extract various minerals and natural resources, including hydrocarbons (e.g., oil and/or natural gas), or configured to inject substances into the earth. In some embodiments, the mineral extraction system 10 is land-based (e.g., a surface system) or subsea (e.g., a subsea system). As illustrated, the system 10 includes a wellhead 12 coupled to a mineral deposit 14 via a well 16, wherein the well 16 includes a well-bore 18.

The wellhead assembly 12 typically includes multiple components that control and regulate activities and conditions associated with the well 16. For example, the wellhead assembly 12 generally includes pipes, bodies, valves and seals that enable drilling of the well 16, route produced minerals from the mineral deposit 14, provide for regulating pressure in the well 16, and provide for the injection of chemicals into the well-bore 18 (down-hole). For example, FIG. 1 illustrates a conductor 22 (also referred to as "conductor casing") disposed in the well 16 to provide structure for well and prevent collapse of the sides of the well 16 into the well-bore 18. One or more casings 24, such as surface casing, intermediate casing, etc., may be fully or partially disposed in the bore of the conductor 22. The casing 24 also provides a structure for the well 16 and well-bore 18 and provides for control of fluid and pressure during drilling of the well 16. The wellhead 12 may include, a tubing spool, a casing spool, and a hanger (e.g., a tubing hanger or a casing hanger), to enable installation of casing and/or tubing. The system 10 may include other devices that are coupled to the wellhead 12, such as a blowout preventer (BOP) 26 and devices that are used to assemble and control various components of the wellhead 12.

The BOP 26 may consist of a variety of valves, fittings and controls to prevent oil, gas, or other fluid from exiting the well in the event of an unintentional release of pressure or an unanticipated overpressure condition. As used herein the term "BOP" may also refer to a "BOP stack" having multiple preventers. The BOP 26 may be hydraulically operated and may close the wellhead assembly 12 or seal off various components of the wellhead assembly 12. During operation of the system 10, a BOP 26 may be installed during removal or installation of additional components, changes in operation of the system 10, or for other safety reasons. The BOP 26 may be any suitable BOP, such as a ram BOP, an annular BOP, or any combination thereof. The BOP 26 shown in FIG. 1 may be a ram BOP having radially moveable rams 27 configured to close off the bore of the BOP 26 and seal the well 16.

A drilling riser 28 may extend from the BOP 26 to a rig 30, such as a platform or floating vessel. The rig 30 may be positioned above the well 16. The rig 30 may include the components suitable for operation of the mineral extraction system 10, such as pumps, tanks, power equipment, and any other components. The rig 30 may include a derrick 32 to support the drilling riser 28 during running and retrieval, a tension control mechanism, and any other components.

The drilling riser 28 may carry drilling fluid (e.g., "mud) from the rig 30 to the well 16, and may carry the drilling fluid ("returns"), cuttings, or any other substance, from the well 16 to the rig 30. The drilling riser 28 may include a drill pipe 34. The drill pipe 34 may be connected centrally over the bore (such as coaxially) of the well 16, and may provide a passage from the rig 30 to the well 16.

FIG. 1 depicts operation of the mineral extraction system 10 during drilling of the well. As shown in FIG. 1, the drill pipe 34 extends from the derrick 32 through the BOP 26, drilling riser 28, and into the well-bore 18. The drill pipe 34 may be coupled to a tool, e.g., a drill bit, to aid in drilling the well. For example, in one embodiment the drill pipe 34 may be rotated and/or translated to drill and create the well. Additionally, the 34 drill pipe may be extended or retracted by adding or removing sections to the drill pipe 34.

During operation of the mineral extraction system 10, different events may result in closing and sealing of the well 16. For example, a loss of control of the well 16 and/or a sudden increase in pressure may result in activation of the BOP 26 to seal off the well. Additionally, in some events, such as bad weather, the rig 30 may stop any operation in the well 16 and relocate to avoid or minimize exposure to the weather. Such events may include or be described as an Emergency Disconnect Sequence ("EDS").

As described above, the BOP 26 may seal off the well 16 through operation of the rams 27, such as by the rams closing and sealing the well-bore 18. In some embodiments, the rams 27 may shear, cut, bend, or otherwise deform the drill pipe 34 to allow extraction of the upper portion 35 of the drill pipe 34 from the well. However, the lower portion 36 of the drill pipe 34 may remain in the well 16. The drill pipe 34 or other material left in the well 16 may be referred to as "fish". Before restarting an operation on the well 16, the fish may be removed from the well 16. However, the deformed portion of the drill pipe 34 presents an unusual shape to retrieve, as well as preventing or increasing the difficulty of attaching retrieval tool to the drill pipe 34.

Figure 2:
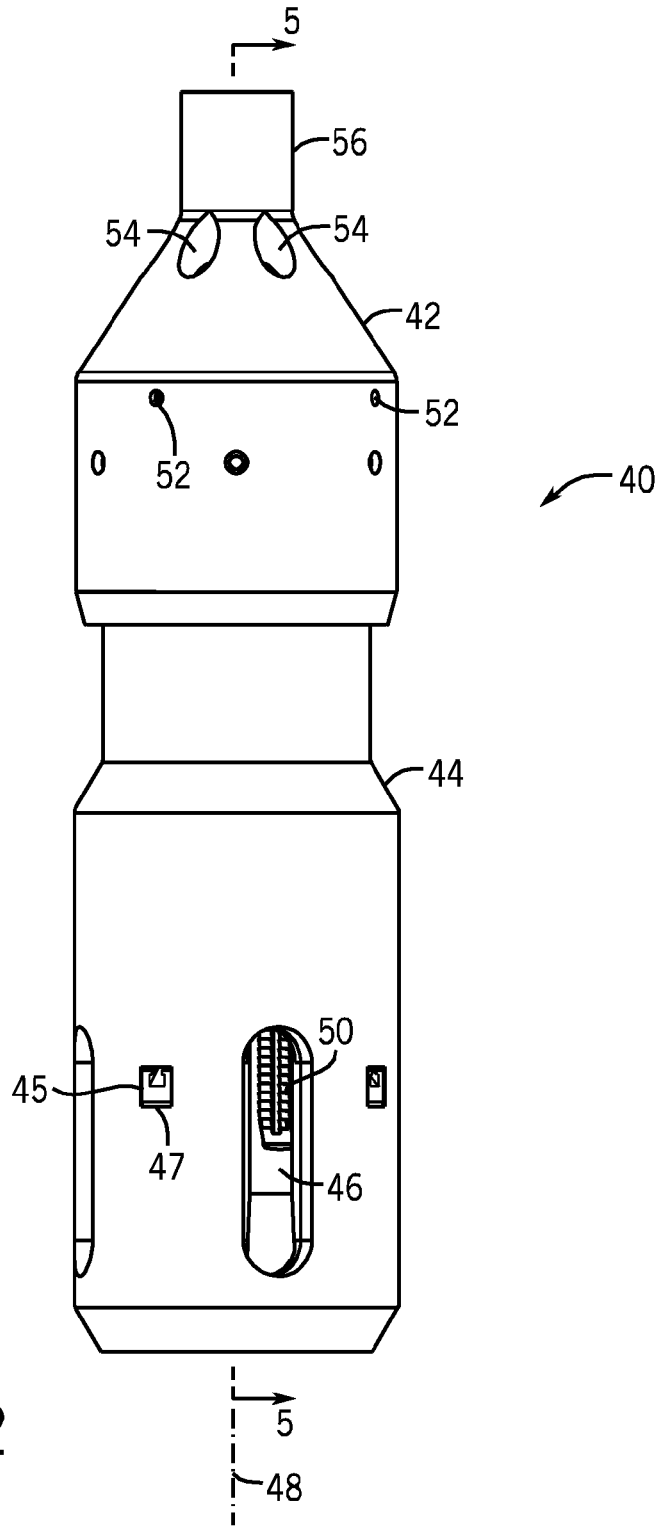
FIG. 2 is a front perspective view of a fishing tool in accordance with an embodiment of the present invention.

FIG. 2 depicts a front perspective view of an assembled fishing tool 40 for retrieving "fish" from a wellhead 12, such as for retrieving the drill pipe 34 described above in FIG. 1. The fishing tool 40 includes an upper frustoconical member 42, an outer tubular member 44 (e.g., an outer sleeve), and an inner tubular member 46. The upper frustoconical member 42, the outer tubular member 44, and the inner tubular member 46 are concentrically disposed around a central axis 48. To enable attachment to and retrieval of fish from the system 10, the fishing tool 40 may include a plurality of jaws 50 disposed within the inner tubular member 46. As described further below, the jaws 50 may be actuated by the outer tubular member 44 to engage the jaws 50 with the drill pipe 34 or other fish disposed in the BOP 26.

The upper frustoconical member 42 of the fishing tool 40 may be secured to the outer tubular member 44 by one or more fasteners 52, such as screws, bolts, welds, rivets, etc. The upper frustoconical member 42 includes one or more holes 54 to enable release of any fluid in the well as the tool is inserted ("run") into the well. The upper frustoconical member 42 also includes a tubular protrusion 56 having a reduced diameter. The tubular protrusion 56 provides a secure attachment point for any tool or pipe used to insert the fishing tool 40 into components of the mineral extraction system 10. For example, in one embodiment, the fishing tool 40 may be secured to the bottom portion of another drill pipe inserted into the BOP 26. The outer tubular member 44 may be coupled to the inner tubular member 46 through engagement of a plurality of tabs 45 of the inner tubular member 46 and corresponding holes 47 configured to receive the tabs.

Figure 3:
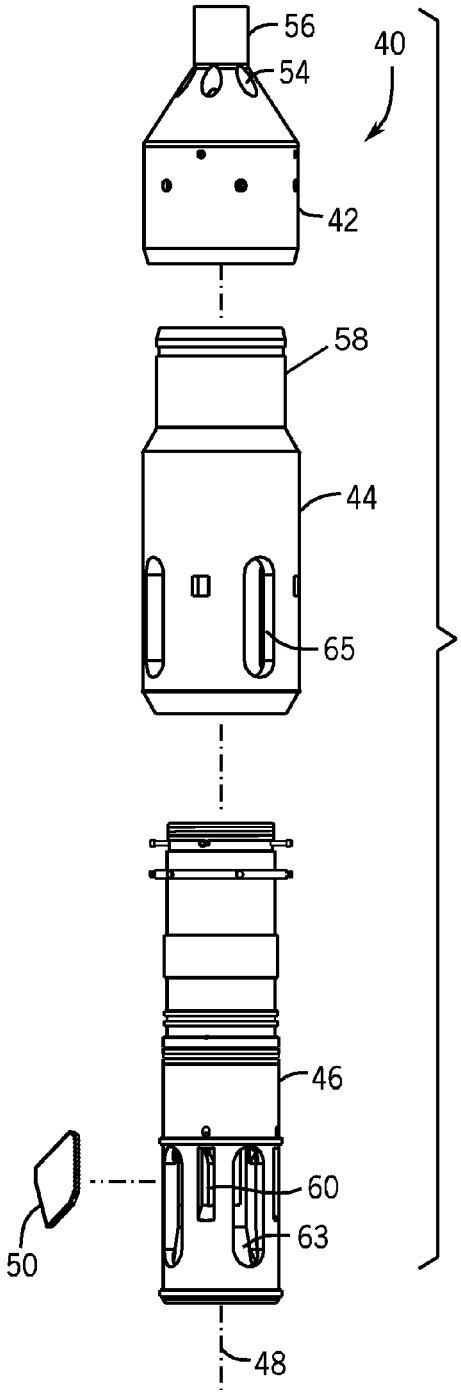
FIG. 3 is an exploded perspective view of the fishing tool of FIG. 2 in accordance with an embodiment of the present invention.

FIG. 3 depicts an exploded perspective view of the fishing tool 40 in accordance with an embodiment of the present invention. As can be more clearly seen in the exploded view, the fishing tool 40 includes the upper frustoconical member 42, the outer tubular member 44, and the inner tubular member 46 concentrically disposed around the central axis 48. The upper frustoconical member 42 may be disposed around the outer tubular member 44, such that some or all of an upper portion 58 of the outer tubular member 44 is received by the upper frustoconical member 42. The outer tubular member 44 may be disposed around the inner tubular member 46, such that all or substantially all of the inner tubular member 46 is received by the outer tubular member 44.

The inner tubular member 46 includes receptacles 60 configured to receive the jaws 50. The receptacles 60 may include upper angled surfaces 62 and lower angled surfaces 64 that secure the jaws. As explained further below, the jaws 50 may move radially towards the central axis 48 when the tool 40 is actuated. The inner tubular member 46 also includes holes 63 to enable release of any fluid in the well as the tool is inserted ("run") into the well. The outer tubular member 44 may include angled interior surfaces that engage and move the jaws 50 when the outer tubular member 44 is translated. The jaws 50 may be secured in the receptacle 60 and disposal of the outer tubular member 44 over the inner tubular member 46 may further secure the jaws 50 in the receptacles 60. The outer tubular member 44 may also include holes 65 to enable release of any fluid in the well as the tool is inserted ("run") into the well 16.

Figure 4:
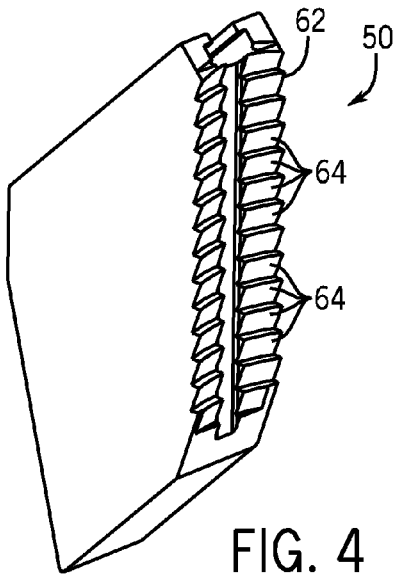
FIG. 4 is a close-up perspective view of a jaw of a fishing tool in accordance with an embodiment of the present invention.

FIG. 4 is a close-up perspective view of one of the jaws 50 in accordance with an embodiment of the present invention. As noted above, the inner tubular member 46 may receive a plurality of jaws 50 disposed around the circumference of the inner tubular member 46. The jaws 50 may be sized and shaped to friction fit in the receptacles 60, such that jaw may be securely fit in the receptacles 60 but movable when radial force is applied to the jaws 50. Each jaw 50 may include an inner facing surface 62 that includes a plurality of teeth 64 or other protrusions. The teeth 64 may be adapted to "bite" a fish, such as the drill pipe 34, upon movement of the jaw 50 into the fish. The teeth 64 of the jaw 50 provide a secure attachment between the fishing tool 40 and the fish, to enable retraction of the fishing tool 40 to remove the fish. Each jaw 50 may include any number or configuration of teeth 64.

Figure 5:
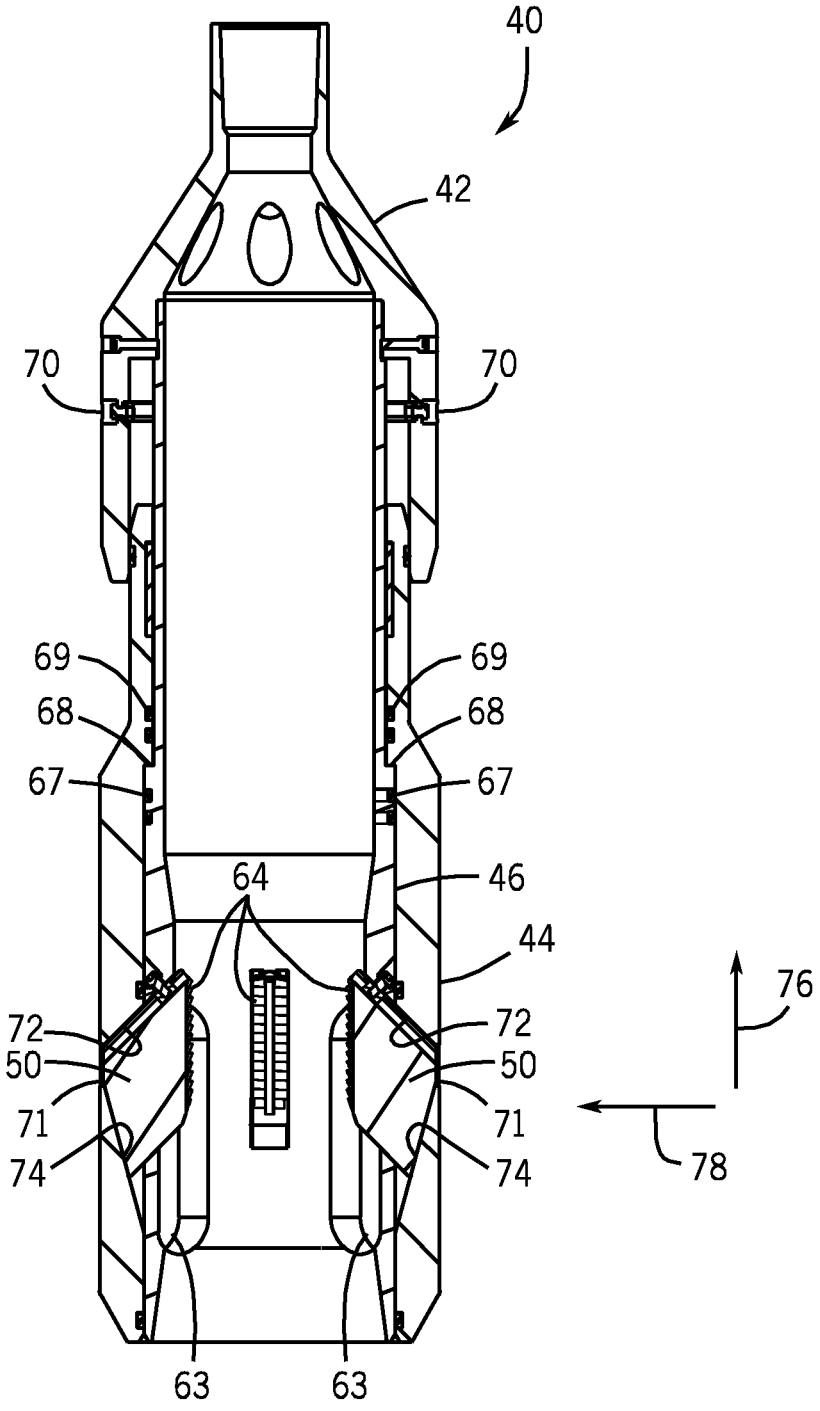
FIG. 5 is a cross-section of a fishing tool taken along line 5-5 of FIG. 2 in accordance with an embodiment of the present invention.

FIG. 5 is a cross-section of the assembled fishing tool 40 taken along line 5-5 of FIG. 2 in accordance with an embodiment of the present invention. FIG. 5 depicts the internal features of the upper frustoconical member 42, the inner tubular member 46, and the outer tubular member 44. As shown in FIG. 5, the interface between the upper frustoconical member 42 and the outer tubular member 44 may form a hydraulic chamber 68. The upper frustoconical member 42 may include internal hydraulic lines 70 fluidly coupled to the hydraulic chamber 68. The upper member 42 may include one or more seals 67, e.g., an O-ring or any other suitable seal, disposed between the interior wall of the upper member 42 and the exterior wall of the outer tubular member 44. The outer tubular member 44 may also include one or more seals 69, e.g., an O-ring or other suitable seal, disposed between the outer wall of the outer tubular member 44 and the inner wall of the upper member 42. Together, the upper member 42 and seal, and outer tubular member 44 and seal, may define chamber 68.

As further shown in FIG. 5, the interior of the outer tubular member 44 includes recesses 71 having upper angled surfaces 72 and lower angled surfaces 74 that receive the jaw 50. The angled surfaces 72 may be configured to match the outer edge of the jaws 50 and aid in retaining the jaws 50 in the receptacles 60. As described further below, to actuate the fishing tool 40, the outer tubular member 44 may be moved in the axial direction illustrated by arrow 76 by hydraulic pressure in the chamber 68. As the outer tubular member 44 moves in the axial direction 76, the lower angled surfaces 74 exert a radial force, indicated by arrow 78, on the jaws 50. The jaws 50 move radially inward toward any fish disposed inside the inner tubular member 46 so that the teeth 64 of the jaws 50 engage the fish. Once the fishing tool 40 is engaged to the fish through the jaws 50, the fishing tool 40 and fish may be removed together.

Figure 6:
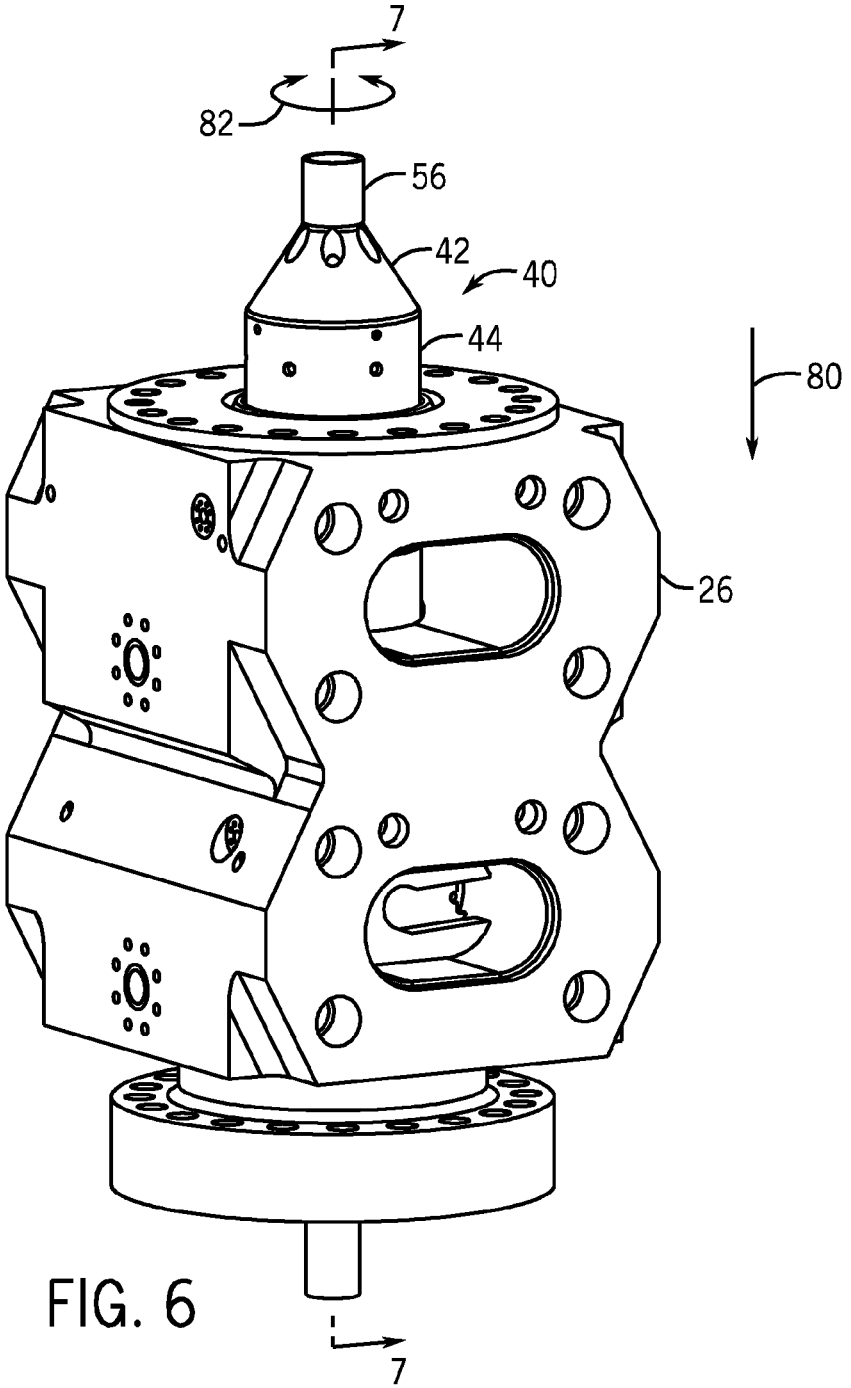
FIG. 6 is a perspective view of a fishing tool installed in a BOP in accordance with en embodiment of the present invention.

FIG. 6 is a perspective view of the fishing tool 40 installed in the BOP 26 in accordance with an embodiment of the present invention. The fishing tool 40 may be inserted into the BOP 26 in the direction indicated by arrow 80, such as to retrieve fish left in the well 16. As mentioned above, the fishing tool 40 may be manipulated by a pipe or other tool coupled to the upper protrusion 56 extending from the upper frustoconical member 42 of the fishing tool 40. When inserting the fishing tool 40 into a well 16, the fishing tool 40 may also be generally rotated in the directions indicated by arrows 82, so that the fishing tool 40 and the jaws 50 may be maneuvered over and around any deformed portions of fish, e.g., drill pipe 34, in the well 16.

Figure 7:
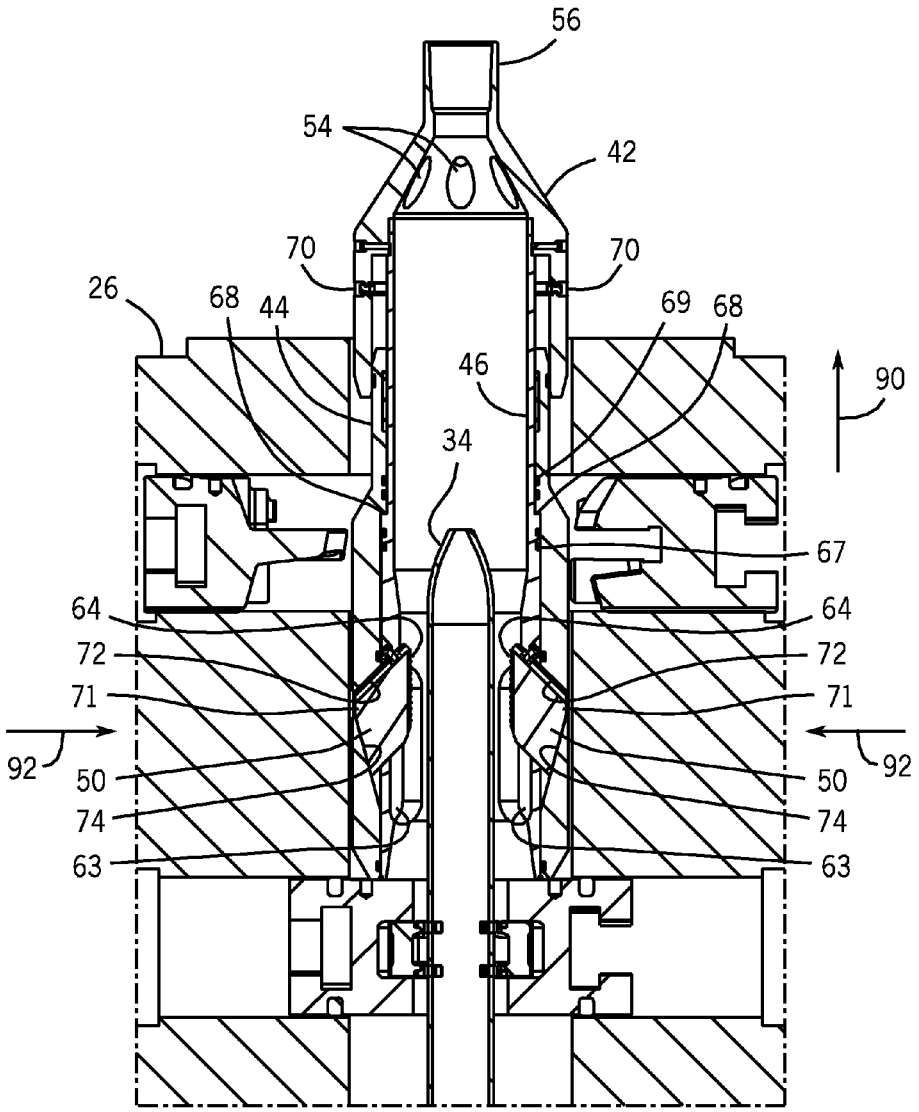
FIGS. 7 and 8 are cross-sections of a fishing tool installed in a BOP taken along line 7-7 of FIG. 6 in accordance with an embodiment of the present invention.

FIG. 7 is a cross-section of the fishing tool 40 installed in the BOP 26 around a drill pipe 34 in accordance with an embodiment of the present invention. The fishing tool 40 may be installed in the BOP 26 to retrieve fish, e.g. drill pipe 34, from the well 16. As noted above, the upper portion of the drill pipe 34 may be deformed, such as sheared, etc., after actuation of the rams 27 of the BOP 26. The fishing tool 40 may then be inserted into the well 16 to retrieve the drill pipe 34 so that drilling operations may resume after removal of the drill pipe 34. As shown in FIG. 7, the fishing tool 40 is in an "unlocked position" such that the jaws 50 of the fishing tool 40 are not engaged with the fish, e.g., drill pipe 34.

As described above, the inner tubular member 46 may include holes 63 disposed around the circumference of the inner tubular member 46. When inserting the fishing tool 40 into the components of the mineral extraction system 10, the holes 63 may allow the fishing tool 40 to displace mud or other fluid so that the fishing tool 40 can be inserted to the desired position. Further, the holes 65 of the outer tubular member 44 may also allow mud or other fluid to be displaced as the fishing tool 40 is inserted.

As noted above, the upper member 42 of the fishing tool 40 may include one or more hydraulic lines 70 that are in hydraulic communication with chamber 68. The chamber 68 may be an annular space defined by the interface of the upper member 42 and the outer tubular member 44 and seals 67 and 69. As mentioned above, the jaws 50 may be captured by receptacles 60 of the inner tubular member 46 and the recesses 71 of the outer tubular member 44. The recesses 71 may include upper angled surfaces 72 and lower angled surfaces 74. As explained below, when the fishing tool 40 is moved from an unlocked position to a locked position, the translation of the outer tubular member 44 in the axial direction indicated by arrow 90 may cause the lower angled surface 74 of the recess to move the jaw 50 into engagement with the fish, e.g., to e.g., "bite" the wall of the drill pipe 34.

As mentioned above, in the position shown in FIG. 7, the fishing tool 40 is an unlocked position such that the jaws 50 are captured by the holes 60 of the inner tubular member 46 and the recesses 71 of the outer tubular member 44. In this position, the jaws 50 of the fishing tool 40 may be maneuvered into the BOP 26 and around any fish. As described above, the fishing tool 40 may be rotated to position the jaws 50 around any fish so that the fishing tool 40 may be lowered into various components of the system 10 to a desired depth.

After the fishing tool 40 is lowered into a desired position, the fishing tool 40 may be set in a "locked position." To set the fishing tool to the "locked position," hydraulic fluid may be applied to the chamber 68 through hydraulic lines 70. The hydraulic fluid causes the chamber 68 to expand, translating the outer tubular member 44 relative to the upper member 42 in the axial direction indicated by arrow 90. The movement of the outer tubular member 44 causes the lower angled surfaces 74 of the recesses 71 to exert an inward radial force on the jaws 50, as illustrated by arrow 92. The jaws 50 may move inward in the radial direction indicated by arrow 92, engaging the teeth 64 of the jaws 50 with the drill pipe 34. In some embodiments, the hydraulic fluid may be contained in the pipe used to suspend and manipulate the tool 40, e.g., the pipe coupled to the protrusion 56.

Figure 8:
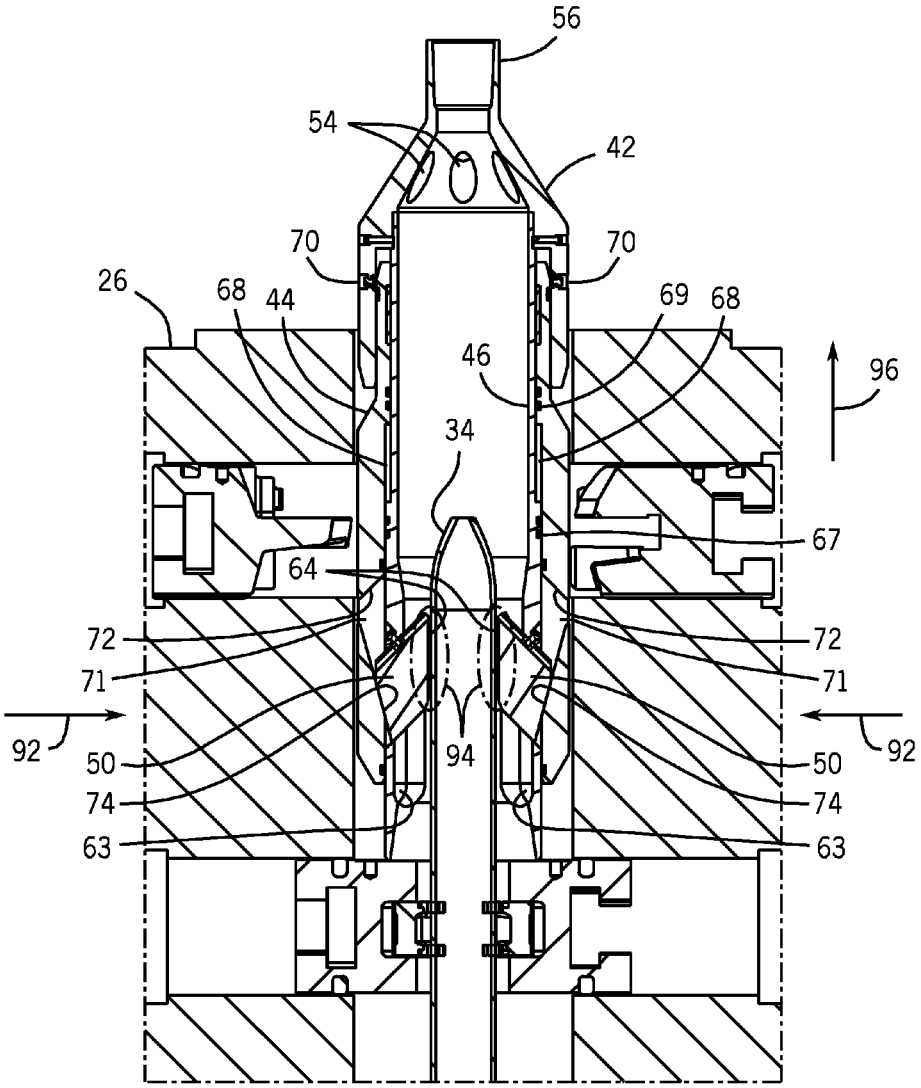

FIG. 8 depicts the fishing tool 40 in a locked position around a fish, e.g., drill pipe 34, in accordance with an embodiment of the present invention. As shown in FIG. 8, the jaws 50 are moved inward relative to the "unlocked position" of FIG. 7 such that the teeth 64 of the jaws 50 engage, e.g., "bite," the walls of the drill pipe 34. Additionally, the outer tubular member 44 has been translated toward the upper member 42, such that the recesses 71 of the outer tubular member 44 are no longer aligned with the jaws 50. As described above, the translation of the outer tubular member 44 to this position exerts an inward radial force, indicated by arrow 92, on the jaws 50, causing the jaws 50 to move inward and bite the drill pipe 34, as shown in regions 94. After the jaws 50 engage with the drill pipe 34, the fishing tool 40 may be removed from the BOP 26, such as by extracting the fishing tool in the axial direction indicated by arrow 96.

Figure 9:
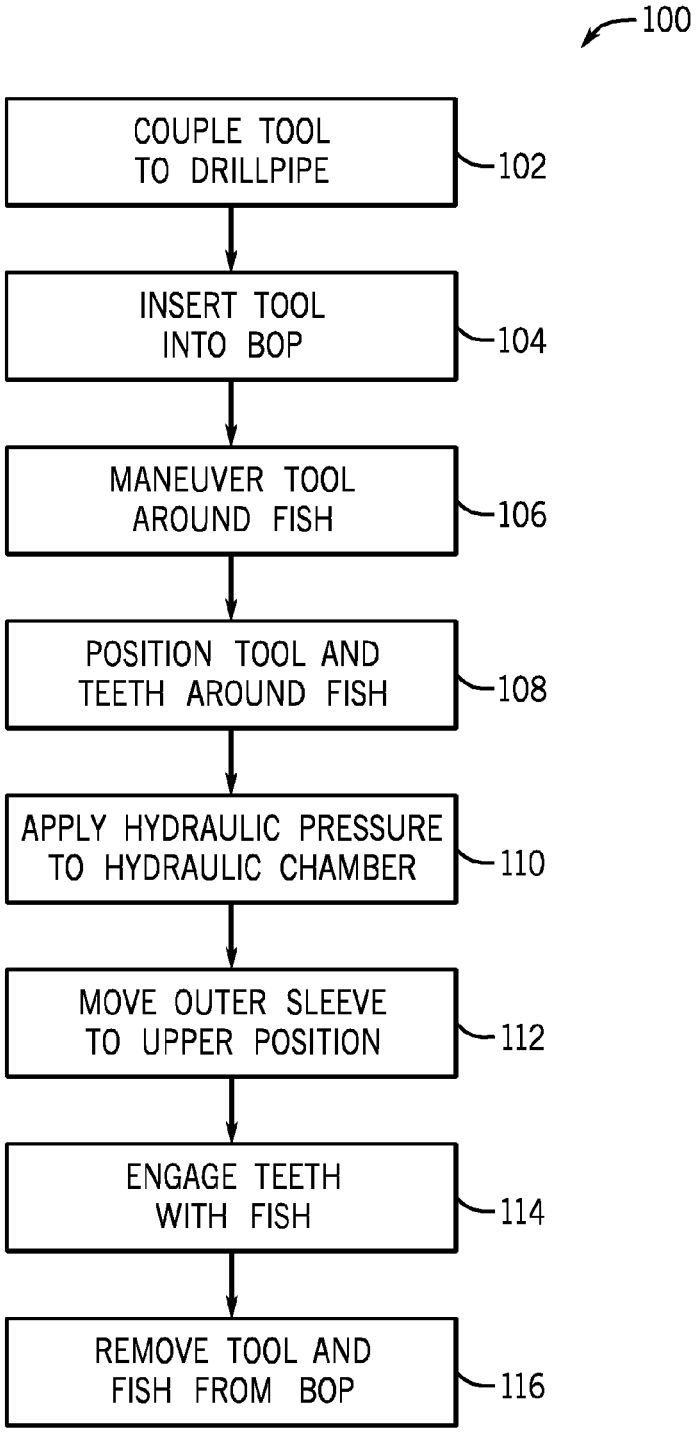
FIG. 9 is a flowchart depicting operation of a fishing tool in accordance with an embodiment of the present invention.

FIG. 9 depicts a process 100 for using the fishing tool 40 to retrieve a fish in accordance with an embodiment of the present invention. Initially, the fishing tool 40 may be coupled to a pipe or other component to be inserted (e.g., run) into the well 16 (block 102). For example, a pipe may be coupled to the upper protrusion 56 of the upper member 42. The fishing tool 40 may then be inserted ("run") into the BOP 26 or other component of the well 16 (block 104). During the insertion process, as described above, the fishing tool 40 may be rotated and translated to maneuver the tool 40 (and jaws 50) around the fish (block 106). The tool 40 may be maneuvered until the tool 40 is in a desired position to enable the jaws 50 to engage a suitable portion of the fish (block 108).

After the tool 40 is positioned, hydraulic pressure may be applied to the hydraulic chamber 68 to move the fishing tool 40 to the locked position (block 110). As described above, application of hydraulic pressure to the chamber 68, causes the outer tubular member 44 to translate in the axial direction to an upper position toward the upper member 40 (block 112). The movement of the outer tubular member 44 causes the lower angled surfaces 74 to apply a radially inward force to the jaws 50, moving the jaws 50 in a radially inward direction to engage (e.g., "bite") the fish (block 114). After locking the tool 40 and engaging the jaws 50 with the fish, the fishing tool 40 and the fish may be removed from the BOP 26 and out of the well 16 (block 116).

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A tool for a mineral extraction system, comprising:

an inner tubular member comprising a plurality of receptacles;

an outer tubular member disposed about the inner tubular member, wherein the outer tubular member comprises a plurality of recesses; and a plurality of jaws disposed in the plurality of receptacles in the inner tubular member and the plurality of recesses in the outer tubular member, wherein each jaw of the plurality of jaws is configured to slide along an angled surface of a respective recess of the plurality of recesses in response to a relative axial movement between the inner and outer tubular members to cause a radial movement of the respective jaw to engage a first component disposed in a second component of the mineral extraction system.

2. The tool of claim 1, wherein each jaw of the plurality of jaws comprises a plurality of teeth disposed on a radially inner surface of each jaw of the plurality of jaws.

3. The tool of claim 1, wherein each jaw of the plurality of jaws has a mating angled surface that slides along the angled surface of the respective recess of the plurality of recesses.

4. The tool of claim 1, wherein the plurality of jaws are friction fit into the plurality of receptacles.

5. The tool of claim 1, wherein each recess of the plurality of recesses comprises an angled upper surface and an angled lower surface, the angled surface comprises the angled lower surface, and the angled lower surface exerts a radially inward force on a respective jaw of the plurality of jaws when the outer tubular member moves in an axial direction.

6. The tool of claim 1, comprising a frustoconical member disposed over the outer tubular member.

7. The tool of claim 6, wherein the frustoconical member comprises a tubular protrusion extending from a first end of the frustoconical member.

8. The tool of claim 6, comprising a hydraulic chamber formed at an intersection of the frustoconical member and the outer tubular member.

9. The tool of claim 6, comprising one or more holes in the frustoconical member, wherein the one or more holes are configured to release fluid pressure.

10. The tool of claim 1, comprising a hydraulic chamber responsive to a fluid pressure to cause the relative axial movement between the inner and outer tubular members and to cause the radial movement of the plurality of jaws.

11. The tool of claim 1, wherein the outer tubular member comprises a first plurality of holes, the inner tubular member comprises a second plurality of holes, wherein the first and second plurality of holes are configured to release fluid pressure.

12. The tool of claim 1, wherein the first component comprises a drill pipe.

13. The tool of claim 1, wherein each jaw of the plurality of jaws is configured to move linearly along an angled path of movement defined by the angled surface of the respective recess of the plurality of recesses.

14. A mineral extraction system, comprising:

a fishing tool configured to retrieve a component, wherein the fishing tool comprises:

an inner tubular member;

a plurality of jaws disposed in the inner tubular member;

an outer sleeve disposed over the inner tubular member, wherein one or more angled surfaces of the outer sleeve engage one or more mating angled surfaces of the plurality of jaws to define angled paths of movement of the plurality of jaws, wherein the plurality of jaws are configured to move linearly along the angled paths of movement; and a hydraulic chamber responsive to a fluid pressure to cause a relative axial movement between the inner tubular member and the outer sleeve that drives the plurality of jaws to slide along the angled paths of movement and move in radial inward directions to engage the plurality of jaws with the drill pipe.

15. The mineral extraction system of claim 14, wherein the plurality of jaws are configured to slide along the angled paths of movement between locked and unlocked positions relative to the component.

16. The mineral extraction system of claim 14, comprising a frustoconical member disposed over a portion of the outer sleeve and configured to enable manipulation of the fishing tool.

17. A method, comprising:

inserting a fishing tool into a first component of a mineral extraction system;

positioning a plurality of jaws disposed in a first tubular member of the fishing tool around a second component disposed in the mineral extraction system;

hydraulically actuating a second tubular member of the fishing tool to move the plurality of jaws along one or more angled surfaces of the second tubular member to cause the plurality of jaws to move radially inward without pivoting; and engaging the jaws with the second component such that the fishing tool is secured to the second component.

18. The method of claim 17, comprising removing the fishing tool and the second component from the mineral extraction system.

19. The method of claim 17, wherein hydraulically actuating the second tubular member comprises driving the plurality of jaws to move linearly along angled paths of movement defined by the one or more angled surfaces of the second tubular member to cause the plurality of jaws to move radially inward.

20. The method of claim 17, wherein hydraulically actuating the second tubular member comprises moving the second tubular member in an axial direction.

21. A tool for a mineral extraction system, comprising:

an inner tubular member comprising a plurality of receptacles;

an outer tubular member disposed about the inner tubular member, wherein the outer tubular member comprises a plurality of recesses; and a plurality of jaws disposed in the plurality of receptacles in the inner tubular member and the plurality of recesses in the outer tubular member, wherein each jaw of the plurality of jaws is configured to move linearly along an angled path of movement relative to a longitudinal axis of the tool, and wherein each jaw of the plurality of jaws is configured to slide linearly along an angled surface defining the angled path of movement in response to selective actuation of the tool.

22. The tool of claim 21, comprising a hydraulic chamber responsive to a fluid pressure to cause a relative axial movement between the inner and outer tubular members and to cause each jaw of the plurality of jaws to move along the angled path of movement.

23. A tool for a mineral extraction system, comprising:

a first tool member;

a second tool member; and a plurality of jaws, wherein each jaw of the plurality of jaws, in response to a selectively actuated relative movement between the first and second tool members of the tool, is configured to slide along an angled surface defining an angled path of movement relative to a longitudinal axis of the tool, and wherein each jaw of the plurality of jaws extends into a receptacle in the first tool member and extends into a recess in the second tool member.

24. The tool of claim 23, wherein each jaw of the plurality of jaws is configured to slide linearly along the angled surface defining the angled path of movement.

25. The tool of claim 23, comprising a hydraulic chamber responsive to a fluid pressure to cause relative axial movement between the first and second tool member and to cause each jaw of the plurality of jaws to slide along the angled surface defining the angled path of movement.

26. The tool of claim 23, wherein each jaw of the plurality of jaws is friction fit into a space in the tool.

27. The tool of claim 23, wherein the tool comprises an actuator configured to cause a relative axial movement between the first and second tool members and to cause each jaw of the plurality of jaws to slide along the angled surface defining the angled path of movement.

* * * * *